US006296218B1

(12) United States Patent
Marra

(10) Patent No.: US 6,296,218 B1
(45) Date of Patent: Oct. 2, 2001

(54) MARINE BILGE PUMP MOUNTING ASSEMBLY

(76) Inventor: Robert T. Marra, 40 W. St., Monmouth Beach, NJ (US) 07750

( * ) Notice: Subject to any disclaimer, the term of this patent is extended or adjusted under 35 U.S.C. 154(b) by 0 days.

(21) Appl. No.: 09/438,610

(22) Filed: Nov. 12, 1999

(51) Int. Cl.[7] ..... E04G 3/00
(52) U.S. Cl. ..... 248/297.21; 248/297.31
(58) Field of Search ..... 248/297.21, 297.31, 248/296.1, 283.1, 295.11, 291.1, 285.1, 287.1, 286.1, 477

(56) References Cited

U.S. PATENT DOCUMENTS

| | | | | |
|---|---|---|---|---|
| 2,920,853 | * | 1/1960 | Bufogle | 248/214 |
| 2,986,366 | * | 5/1961 | Wesson | 248/285 |
| 3,673,828 | * | 7/1972 | Jones | 70/58 |
| 3,945,227 | * | 3/1976 | Reiland | 70/58 |
| 4,024,737 | * | 5/1977 | McInturff | 70/58 |
| 4,073,455 | * | 2/1978 | Gunther | 248/291 |
| 4,079,604 | * | 3/1978 | Anderegg | 70/58 |

* cited by examiner

*Primary Examiner*—Ramon O. Ramirez
*Assistant Examiner*—A. Joseph Wujciak
(74) *Attorney, Agent, or Firm*—Charles I. Brodsky

(57) ABSTRACT

A mount to locate a marine bilge pump to increase serviceability, including an upper section which removably fastens to the bulkhead, stringer bed or deck brace of the boat, hinged to a center section which allows for angular orientation to be achieved with respect to a bottom section serving to support the bilge pump in a plane parallel with the bottom of the boat, and with the center section being extendable in length to set the spacing between the upper and bottom plates in accordance with the size of the bilge pump to be mounted. In the preferred embodiment described, the center section includes two or more sections nesting together, having a plurality of apertures in each, and in which the shafts of a pair of rotatable knobs are inserted through overlying apertures in alignment to set the length of the center section in accordance with the dimensions of the bilge pump to be supported between the upper and bottom plates.

7 Claims, 5 Drawing Sheets

MARINE BILGE PUMP MOUNTING ASSEMBLY

FIELD OF THE INVENTION

This invention relates to the recreational and commercial boat industry and, in particular, to the mounting of marine bilge pumps and their associated float switches.

BACKGROUND OF THE INVENTION

As is known and understood to most marine engineers and technicians, the mounting of a bilge pump is often in the harshest environment of the boat for purposes of servicing. As is also well appreciated, even though the bilge pump is one of the most frequently serviced apparatus on the vessel, ifs placement frequently requires a service technician to be somewhat of a contortionist in order to remove a defective pump, and to replace it where the need arises. In single-engine, or twin-engine boats of 14–40 foot mid-size length, for example, the bilge pump commonly is some 4 feet away, under the oil pan (in single-engine designs) or at a location offering only some 6–8 inches of working space (in a twin-engine design). As will be understood, the service technician typically works "blind" by "feel" in such environments, wasting time and energy in what otherwise should be a simple servicing procedure. As will be recognized by those in this industry, the situation is commonly dealt with by just cutting the wires and the hosing, and inserting instead a whole new installation when a bilge pump problem exists—"dead-ending" the old location, and bending pieces of aluminum to fit in mounting a new bilge pump to a different location at the bulkhead, engine stringer bed, etc., and drilling further holes to secure the bilge pump in place using alternative fasteners.

OBJECTS OF THE INVENTION

It is an object of the present invention, therefore, to provide a new and improved marine bilge pump mounting configuration which allows for simple repairs to be made—swiftly, easily and inexpensively.

It is an object of the invention, also, to provide such a mounting arrangement which could be utilized as original equipment manufacture, or as something which can be added in the after-market.

It is another object of the invention to provide such a bilge pump mounting arrangement which can be employed independent of the size and dimensioning of the bilge pump employed—whether it be for the smaller (i.e. 12 foot) boat or up to the larger (100 foot or so) models available in the recreational boat industry.

It is a further object of the invention to provide a bilge pump mounting arrangement of this type which continues to retain the bilge pump, once inserted, in a plane parallel with the bottom of the boat in which it is incorporated, so as to optimize its operation in ridding the boat of rainwater which collects and of seawater which seeps into the boat during use.

SUMMARY OF THE INVENTION

As will become clear from the following description, a marine bilge pump mount according to the invention secures to a bulkhead, stringer bed or deck brace of a boat, and employs a top plate for removable fastening to the boat and a bottom plate for receiving the bilge pump. A center section is provided, coupled at a first end to the top plate and at a second end to the bottom plate—, with the center section being angularly adjustable with respect to the position of at least one of the top and bottom plates. As will be described, the center section is adjustable in length to vary the distance between the top and bottom plates. In a preferred embodiment, the center section is hinged to both the top and bottom plates at the first and second ends of the center section, respectively.

In this embodiment, the center section includes a front piece coupled to the bottom plate and a rear piece coupled to the top plate, with both front and rear pieces being joined together in adjusting the length of the center section. One manner of accomplishing this, to be described, utilizes a rear piece of the center section having a plurality of apertures in it, to receive the shaft of a knob, for example, extending through the front piece into an aperture at a desired location, with the knob being rotatable to then tighten the front piece against the rear piece. To further strengthen the join, the shaft of a second knob is employed, to likewise extend through the front piece to the apertures of the rear piece—and to facilitate this in one construction of the invention, the front piece of the center section is slotted. As will be seen, the front piece of the center section is hingeably coupled to the bottom plate, while the rear piece of the center section is hingeably coupled to the top plate.

As will be appreciated by those skilled in the art, the bottom plate is selected of a dimension to receive and support the marine bilge pump, and the hinge coupling allows for the pump to rest in a plane parallel with the bottom of the boat. As will also be appreciated, with the center section being adjustable in length, the distance between the upper and bottom plates of the marine bilge pump mount can be set for the particular sized pump being used.

A second embodiment of the invention will be noted to employ a somewhat different center section—which includes two or more tubular sections nesting together, which contain a plurality of apertures in each, and in which the shafts of the pair of rotatable knobs are inserted through overlying apertures in alignment to set the length of the center section according to the size of the bilge pump being supported. In this second embodiment, a first bracket is provided for receiving a first end of the center section, and is hingeably coupled to the top plate which fastens to the boat. A second bracket is provided for receiving the second end of the center section, and is hingeably coupled to the bottom plate upon which the bilge pump is supported. As with the first embodiment of the invention, the center section here is thus likewise angularly adjustable with respect to the position of the top and bottom plates. In this embodiment, the shafts of the knob securements extend between aligned apertures of the inner and outer tubular sections in setting the length of the center section and the desired distance between the top and bottom plates. With the bottom plate again being selected of a dimension to receive and support the marine bilge pump in a plane parallel with the bottom of the boat, this second assembly will similarly be seen to allow for a removable fastening to the boat, and an ease in being able to reach the pump for servicing it, if and when the need arises.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
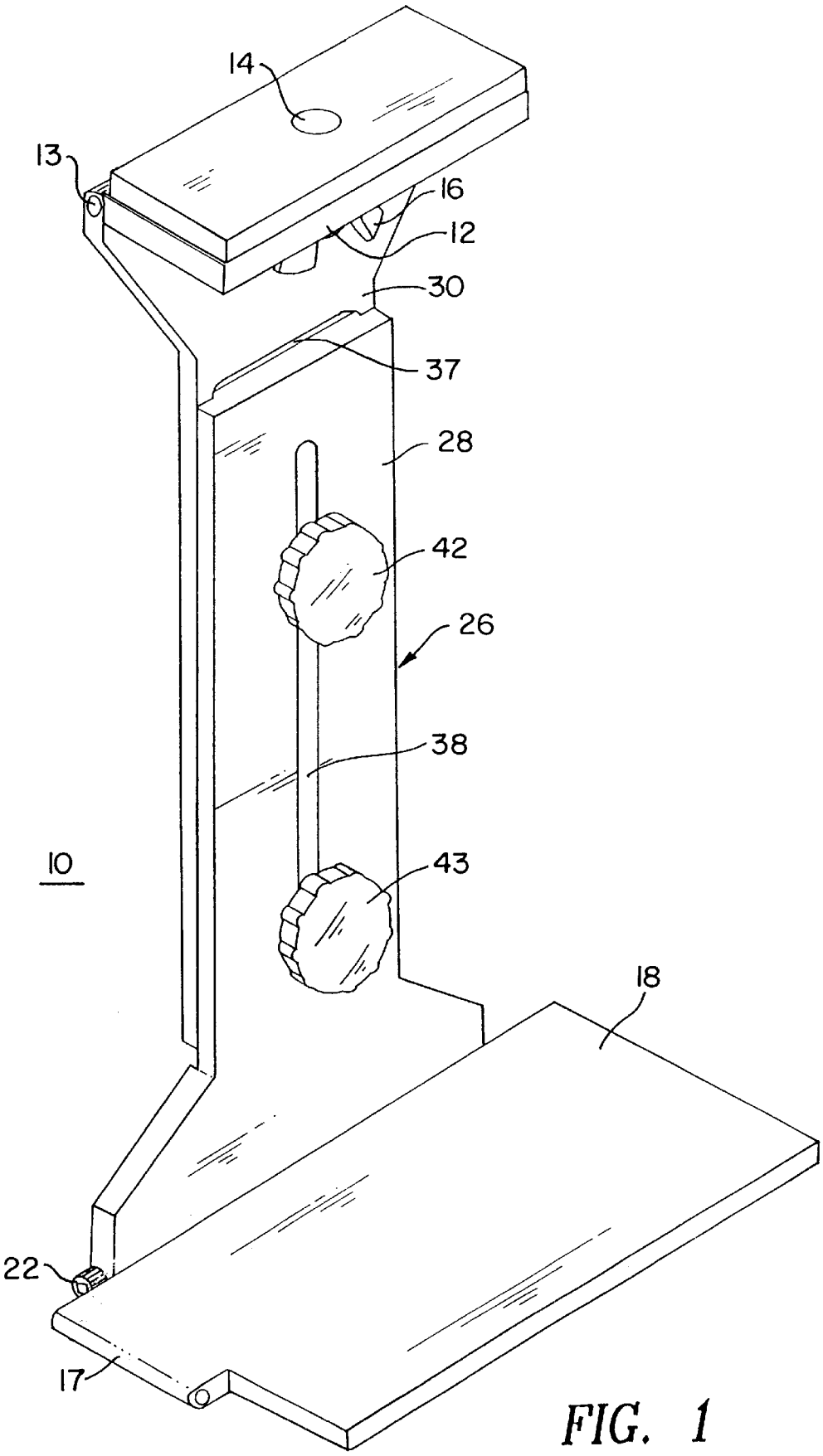
FIG. 1 is a front perspective view of a marine bilge pump mount according to a first embodiment of the present invention.
Figure 2:
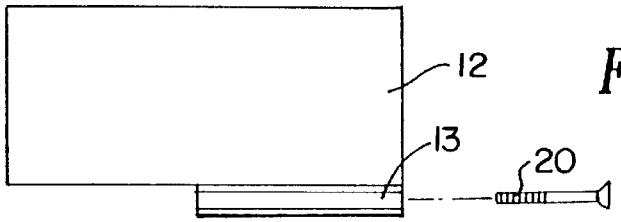
FIGS. 2–9 are disassembled views of the component parts of the marine bilge pump mount helpful in an understanding of the manner of its arrangement.

In the marine bilge pump mount 10 of FIGS. 1–9, a top plate 12 is shown for fastening to a boat in any appropriate manner (as to its bulkhead, stringer bed or deck brace, for example), with a bolt 14 and wing nut 16 being illustratively indicated for effecting that securement. A bottom plate 18 receives and supports the pump and its float switch assembly (not shown). As depicted in FIG. 2, the top plate 12 includes a channel 13 which is bored to receive a threaded hinge pin 20, while a pair of such bored channels 15, 17 are provided at offset sides 19, 21 of the bottom plate 18 (FIG. 3), with internal threads therein 21. As with the channel 13, the channels 15, 17, are dimensioned to receive a threaded hinge pin, shown at 22. The channels 15, 17 are offset perpendicularly to allow for spatial orientation of the bottom plate 18 to support the bilge pump to be mounted at different locations in the boat.

Figure 5:
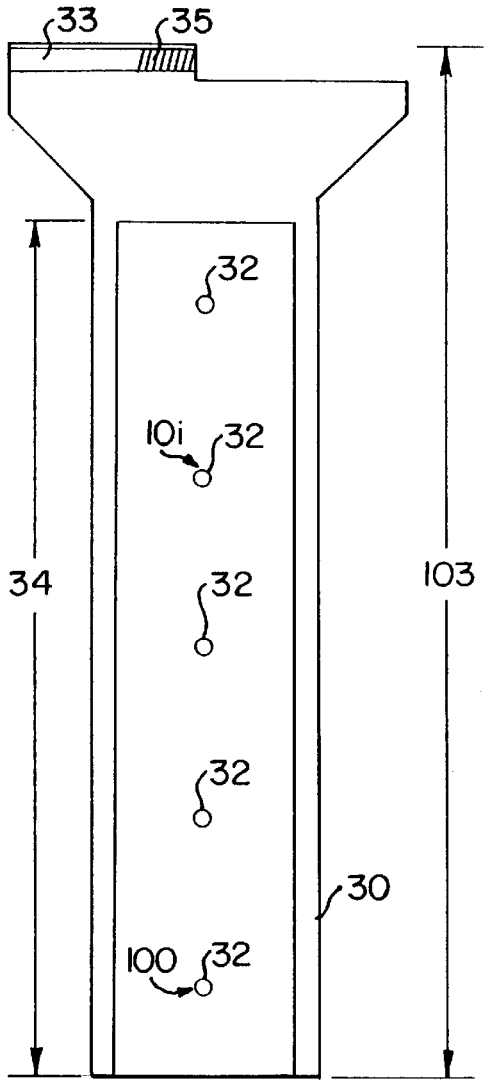
Figure 4:
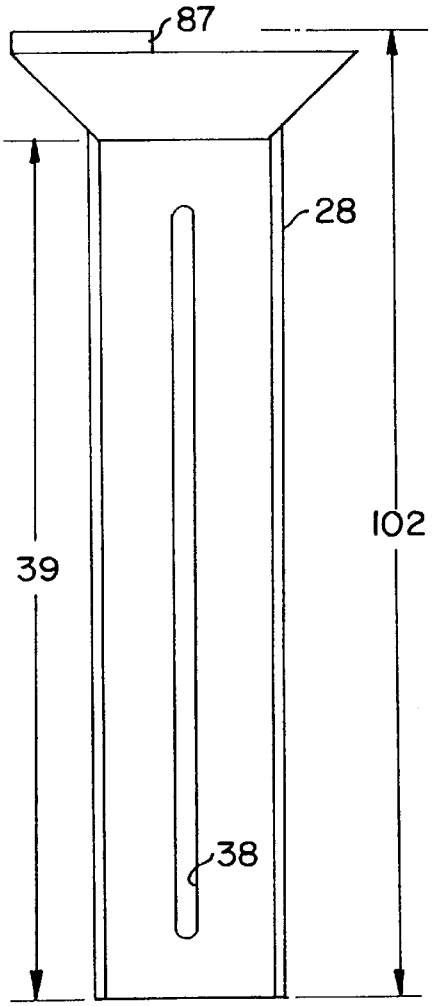
Figure 6:
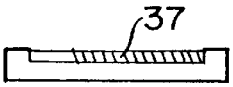

The marine bilge pump mount further includes a center section 26 including a front piece 28 (FIG. 4) and a rear piece 30 (FIG. 5). As shown in FIG. 5, the rear piece 30 includes a plurality of apertures 32 spaced along its length 34. The rear piece 30 also includes its own channel 33, bored to receive the hinge pin 20, and threaded, as at 35, to fasten with the channel 13. This allows for angular rotation and adjustment between the top plate 12 and the center section 26. FIG. 6, in this respect, represents a bottom end view of the rear piece 30, which is itself grooved, as at 37, to receive the overlying front piece 28 of the center section 26.

Figure 7:
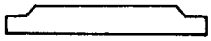

The front piece 28 (FIG. 4), is slotted along its length 39, as at 38, and has its own channel 87 bored to receive the hinge pin 22 which extends through the channel 87 into the channel 15 where it is threaded in place. In such manner, the angle between the bottom plate 18 and the center section 26 is similarly adjustable, to maintain and support the bilge pump in a plane parallel with the bottom of the boat. FIG. 6 particularly shows the slot 38 of the front piece 28 extending a length to overlap the apertures 32 of the rear piece 26. FIG. 7 represents a top end view of the front piece 28, helpful in understanding the manner of fitting the front piece 28 within the groove 37 of the rear piece 30 (FIG. 6).

Figure 8:
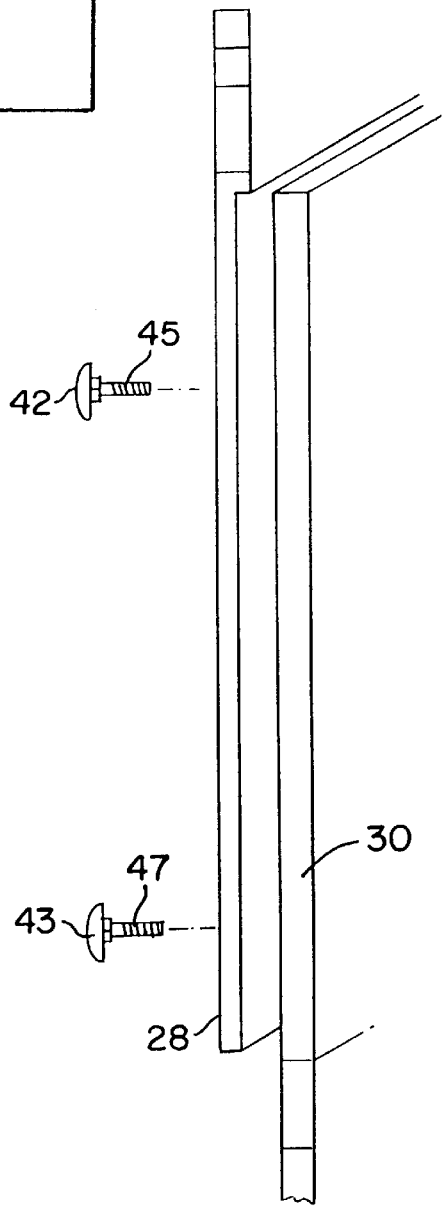

In FIG. 8, a pair of knobs 42, 43 with threaded screw shafts 45, 47 are employed (although any type of similar cap or fastening means may be employed), with the shafts being of dimension to extend through the slot 38 of the front piece 28, to join with the apertures 32 of the rear piece 30. The shafts are threaded, to tighten with the apertures 32 as the knobs 42, 43 are rotated, in securing the front and rear pieces 28, 30 together.

In arranging the bilge pump mount 10 for use, the front piece 28 and the rear piece 30 of the center section 26 are moved along their length 34, 39 in the groove 37 until the spacing between the top plate 12 and the bottom plate 18 is sufficient to provide clearance for the bilge pump to be supported. The shafts of either or both of the knobs 42, 43 fit through the slot 38 to extend into the appropriate aperture (s) 32 of the rear piece 30, where the knobs are rotated to tighten them and fix the distance between the plates. With the arrangement illustrated in the perspective view of FIG. 1, for example, such shafts might extend through the apertures 100, 101 of the view of FIG. 5. While only one knob could be employed in effecting the join between the front and rear pieces 28, 30, in this manner, a pair of such knobs are preferable, in providing a greater tightening and a resistance to any tendency for bending produced by the weight of the bilge pump being supported on the bottom plate 18. A rotation of the threaded hinge pins 20, 22 tightens the angular adjustment between the plates 12 and 18 and the pieces 30, 28, respectively.

Figure 3:
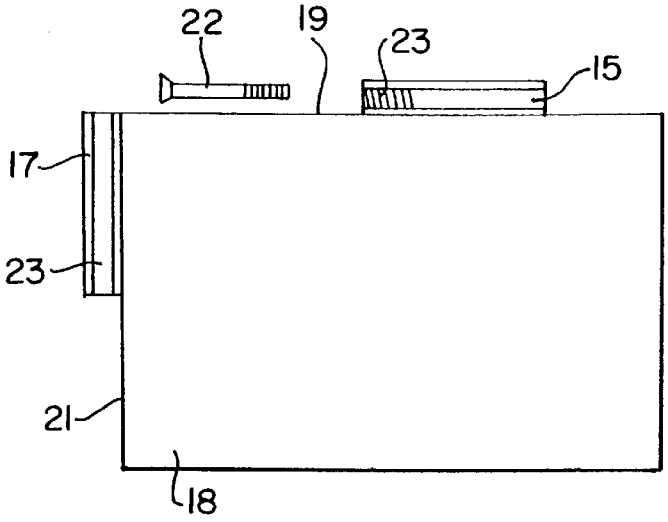
Figure 9:
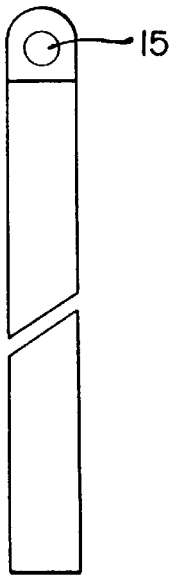

FIG. 9 represents a left side view of the bottom plate 18 of FIG. 3 showing the bored-out channel 15—of some 0.28" outer diameter, for example, with a 0.25×20 internal thread. The bottom plate 18 may be selected of ⅜"×4"×6" dimension, measured between the channels 15, 17, while the top plate 12 may be of ⅜"×2"×4.5" dimension, with comparable bored-out channel size. Depending upon the size of the bilge pump and where the pump is to be mounted, the various lengths 102, 103 for the front piece 28 and the rear piece 30 could be selected to provide a distance between the top and bottom plates 12, 18 of anywhere from some 24" to 48". As will be appreciated, the greater the distance between the plates 12, 18, the greater is the need to provide the second knob 43 (or even further additional knobs), to extend through the slot 38 into the aperture 32 in resisting the torque produced by the weight of the pump.

Figure 10:
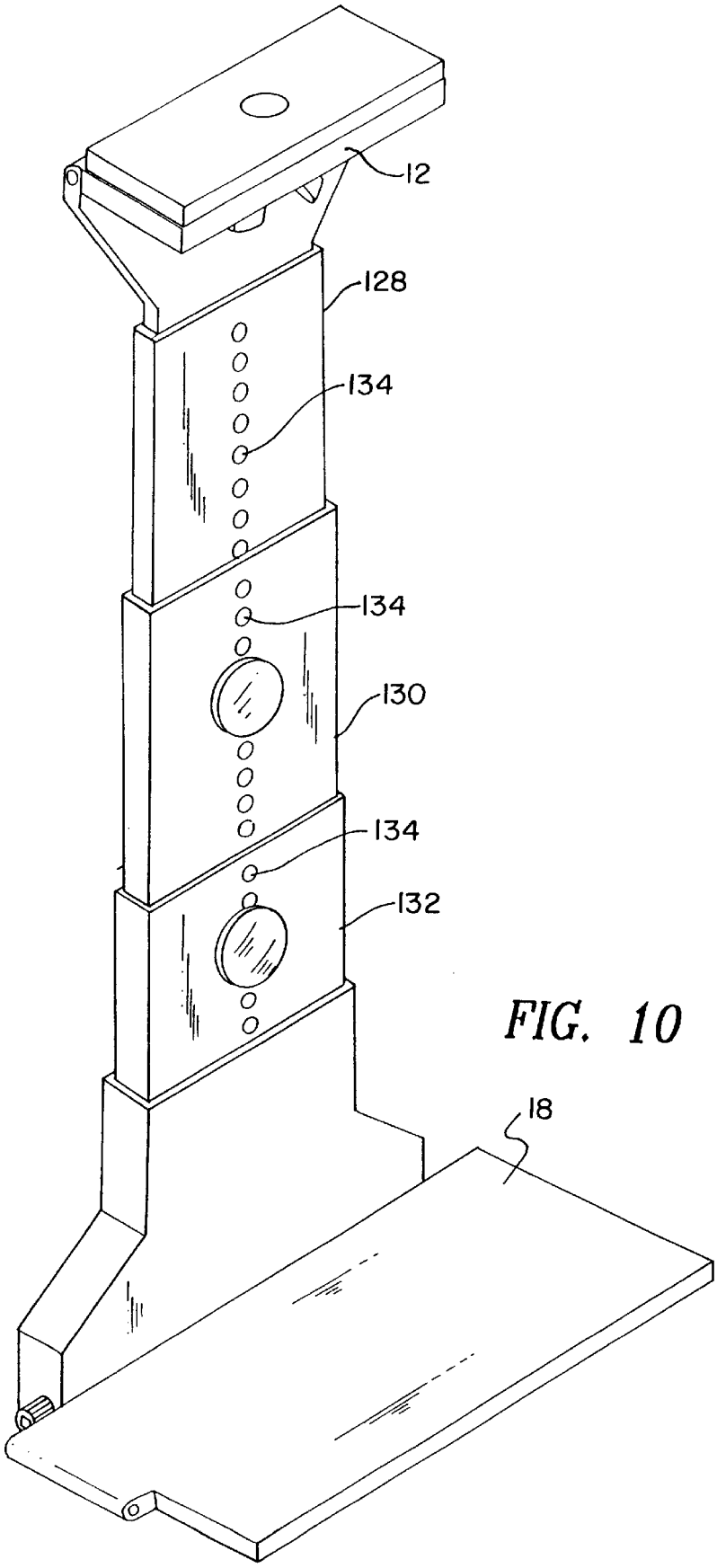
FIG. 10 is a front perspective view of a marine bilge pump mounting assembly according to a second embodiment of the invention.
Figure 11:
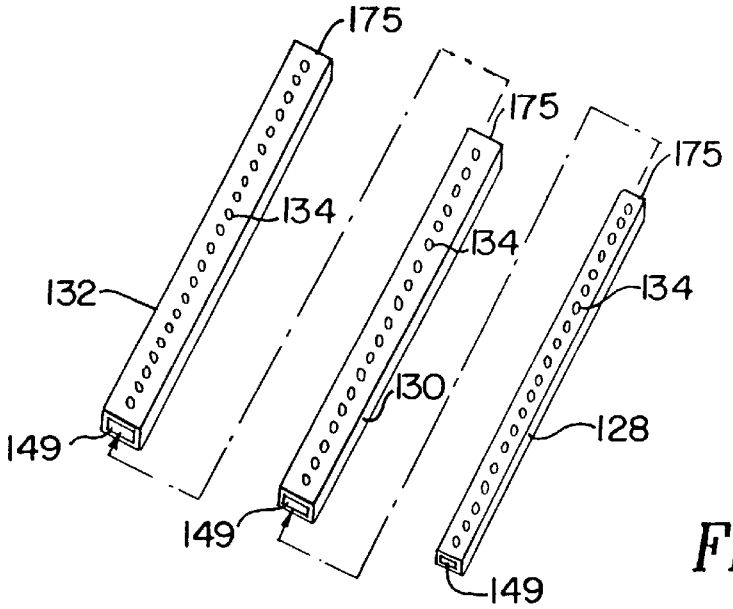
FIGS. 11–13 are disassembled views of the component parts of the marine bilge pump mounting assembly helpful in an understanding of its manner of arrangement.

In the second embodiment of the invention illustrated in FIG. 10, on the other hand, the center section 126 includes an inner section 128 and an outer, telescoping tubular section 130 of greater cross-section (along with a third tubular section 132 of even larger diameter for increased separation). As shown in FIG. 11, each section 128, 130, 132 includes a plurality of apertures 134 of comparable size positioned to overlie one another as the inner section 128 inserts within the outer tubular section 130—which, in turn, fits within the third tubular section 132. Although the inner section 128 may be fabricated to be tubular in nature, as it will only receive a tightening screw in a manner to be described, the inner section 128 may be of otherwise solid construction.

Figure 12:
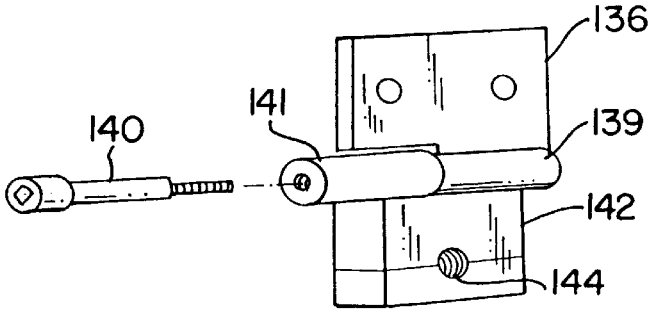

A top plate 136 is shown in FIG. 12 for fastening to the bulkhead, stringer bed or deck brace of the boat. The top plate 136 includes its own channel 139, threaded and bored internally to receive a threaded hinge pin 140. A top mounting bracket 142 is shown, with its own channel 141, bored to receive the hinge pin 140 in alignment, thereby coupling the bracket 142 to the top plate 136. Such bracket 142 is of internal configuration to receive the top end 175 of the sections 128, 120 or 132 of the center section, and is of appropriate dimension to retain it in position upon receipt of a threaded shaft extending through an aperture 144 of the mounting bracket 142 and into the apertures 134 of the sections 128, 130, 132 arranged in alignment in accordance with the desired length for the telescoping sections. A similar knob of the type shown in FIGS. 1 and 8 could be utilized for this purpose, with the shaft thereof passing through the aperture 144, tightened to hold the sections 128, 130, 132 together upon rotation of the knob.

Figure 13:
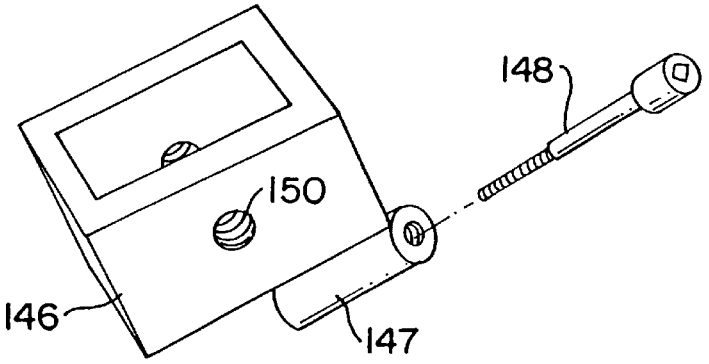

In similar manner, a second, bottom mounting bracket 146 is provided (FIG. 13) with its own channel 147 bored to receive a second threaded hinge pin 148 which extends through and into the channel 15 or 17 of the bottom plate 18 in coupling the bracket 146 to the bottom plate 18. As with the top mounting bracket 142, the bottom mounting bracket 146 is dimensioned to receive the bottom ends 149 of the sections 128, 130, or 132, where they are then further secured in position by a threaded shaft of yet another knob extending through a mounting bracket aperture 150 joining with the apertures 134 of the sections 128, 130, 132 adjacent their lower ends. In this manner, the bottom mounting bracket 146 is hingeably coupled with the bottom plate 18 at an adjustable angle, as is the top mounting bracket 142 with the top plate 136. The length of the telescoping section is set with the apertures 134 to control the distance between the top and bottom plates, in accordance with the size of the pump to be supported. The knob screws in the aperture 144 in the top mounting bracket 142 and in the aperture 150 in the bottom mounting bracket 146 then secure the center section in position, as with the knobs 42, 43 with the center section 26 of FIGS. 1 through 9. And, as with the bilge pump mount of FIGS. 1–9, the lengths of the sections 128, 130 and 132 can be selected so as to telescope the top and bottom plates anywhere from 24"–48" —or, otherwise for example, as the size of the bilge pump to be supported may require. Additionally, and where desired, the rear of the bottom mounting bracket 146 could also be bevelled so as to achieve a greater angle of adjustment (and, thereby an enhanced servicing), before any interference with the hull results.

As will be understood, with the embodiments described above, the mounting unit serves to locate the marine bilge pump in such a manner that its serviceability can be greatly increased. In use, the top or mounting plate allows for beneficial securement of the mount to the boat location which is most accessible, for easy removal when service is required. With the upper section being hinged to the center section, an optimum angle to allow for this can be achieved, and with the center section being extendible, a proper distance between the top and bottom plates can be obtained, then locked in place. With the lower section being also hinged to the center section, an optimum angle can be achieved at the lower end of the mount, and in a manner which allows for the bottom plate to be oriented parallel with the bottom of the boat for proper pump operation to follow. As will be appreciated, the bilge pump and its related float switch assembly are mounted on this bottom plate.

While there have been described what are considered to be a preferred embodiments of the present invention, it will be readily appreciated by those skilled in the art that modifications can be made without departing from the scope of the teachings herein of providing a fully adjustable, articulating and expanding pump platform of whatever size may be required, which allows for the easier servicing of a marine pump in use. Thus, whereas the embodiment of FIG. 10 illustrates a center section including three sections which nest together, depending upon the dimension of the bilge pump employed, the three sections could be telescoped outwardly for larger size pumps, or nested together for smaller bilge pumps. For at least such reason, therefore, resort should be had to the claims appended hereto for a true understanding of the scope of the invention.

I claim:

1. A marine bilge pump mounting assembly for securement to a bulkhead, stringer bed or deck brace of a boat, comprising:

a top plate for fastening to said boat;

a bottom plate for receiving said bilge pump;

a center section having first and second ends;

a first bracket for receiving said first end of said center section, and coupled to said top plate;

a second bracket for receiving said second end of said center section, and coupled to said bottom plate;

with said center section being angularly adjustable with respect to at least one of said first and second brackets;

and with said center section being positionable in said first and second brackets at predetermined locations along a length thereof to set the distance between said top and bottom plates at any given instant of time;

means for joining said first and second brackets and said center section at said predetermined location; and wherein said center section includes an outer tubular section having a first plurality of apertures along a first given length, and an inner tubular section having a second plurality of apertures along a second given length, wherein said joining means extends between aligned apertures of said first and said second plurality of apertures in setting the adjustable length of said center section.

2. The bilge pump mounting assembly of claim 1 wherein said top plate is removably fastenable with respect to said boat.

3. The bilge pump mounting assembly of claim 1 wherein said center section is angularly adjustable with respect to the position of both of said first and second brackets.

4. The bilge pump mounting assembly of claim 3 wherein said center section is hingeably coupled to said first bracket at said first end and wherein said center section is hingeably coupled to said second bracket at said second end.

5. The bilge pump mounting assembly of claim 1 wherein said center section includes a plurality of apertures along its said length and wherein said joining means extends through said first and second brackets to align with a pair of said apertures in setting the adjustable length of said center section.

6. The bilge pump mounting assembly of claim 5 wherein said joining means includes a first knob having a shaft to screw into one of said plurality of apertures, and rotatable to tighten the join between said first bracket and said first end of said center section, and also includes a second knob having a shaft to screw into another one of said plurality of apertures, and rotatable to tighten the join between said second bracket and said second end of said center section, respectively.

7. The bilge pump mounting assembly of claim 1 wherein said bottom plate is selected of a dimension to receive and support a marine bilge pump in a plane parallel with the bottom of said boat.

* * * * *